United States Patent [19]

Chiu-Rong

[11] Patent Number: 4,682,611

[45] Date of Patent: Jul. 28, 1987

[54] PORTABLE CIGARETTE SAFETY ASH TUBE AND EXTINGUISHER

[76] Inventor: Wuu Chiu-Rong, c/o Y. L. Yang P.O. Box 865, Kaohsiung, Taiwan

[21] Appl. No.: 724,812

[22] Filed: Apr. 18, 1985

[51] Int. Cl.[4] ..... A24F 3/02; A24F 7/02; A24F 47/00

[52] U.S. Cl. ..... 131/256; 131/175; 131/178; 131/198.2

[58] Field of Search ..... 131/198.1, 256, 198.2, 131/175, 178

[56] References Cited

U.S. PATENT DOCUMENTS 450,312 4/1891 Hieatzman ..... 131/256

2,440,882 5/1948 Walton ..... 131/256

*Primary Examiner*—Vincent Millin

[57] ABSTRACT

A portable cigarette ash tube consisting of an inner tube and an outer tube jointed in a telescopic manner. The outer tube is connected to a cigarette holder. The inner tube having micro holes for ventilating but capable of preventing the drop of ash. A cone shaped bladed scratcher is provided on the inside bottom wall of the inner tube. The smoker, if he doesn't want to smoke any longer, can retract and turn the inner tube to scratch down the ember end of the cigarette thus extinguishing the cigarette by the cone shaped bladed scratcher. The smoker also can retract the tube completely to block out the ventilating holes and lie down the cigarette when the cigarette is too short to be scratched.

2 Claims, 4 Drawing Figures

PORTABLE CIGARETTE SAFETY ASH TUBE AND EXTINGUISHER

BACKGROUND OF THE INVENTION

Many kinds of ash disk have been used separately with a pipe but this invention is used together with the pipe, making it portable and convenient. The tubular ash disk forms a protection to prevent any fire hazard from negligence.

SUMMARY OF THE INVENTION

One object is the provision of a portable cigarette ash tube with micro holes drilled in a surrounding side circular wall of the tube for ventilation but which will prevent the ash from dropping out of the tube.

Another object of the invention is the provision of a telescopic cover around the tube which will completely close out the micro holes from ventilating and die down the cigarette when necessary. Still another object of the invention is the provision of a cone shape bladed scratcher on the inside bottom end wall of the tube for scratching down the ember end of the cigarette when necessary.

PREFERRED EMBODIMENT DESCRIPTION

Figure 1:
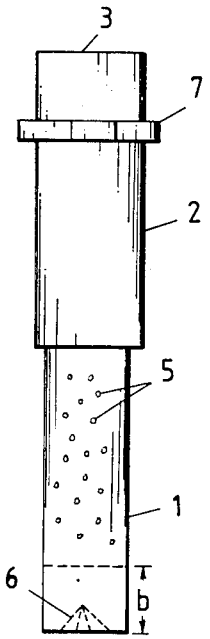
FIG. 1. is an over all side view of the invention.

Shown in FIG. 1 the invention consists of an inner tube 1 and an outer tube 2 both jointed in a telescopic manner. Top opening 3 of the outer tube is connective to a cigarette holder or pipe. There are micro holes 5 drilled around the side wall of the inner tube for ventilation except the portion b. A cone shape bladed scratcher 6 is provided stationary on the inner bottom wall of the inner tube. The smoker can retract and twist the inner tube to scratch down the ember end of the cigarette by said scratcher and extinguish the cigarette whenever he doesn't want to smake any more. However, if the cigarette has burnt down to a length less than the outer tube, the smoker may just push the inner tube to fully retract the outer tube, thereby shuting off the micro holes and extinguishing the cigarette. A multi angle flange is mold formed on the outer tube for preventing the tube from accidentally rolling and dropping.

Figure 2:
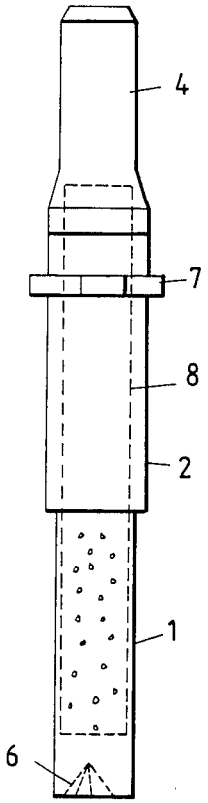
FIG. 2. is the side view of the invention being connected with a cigarette holder.
Figure 3:
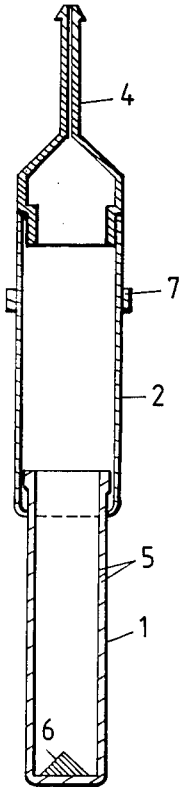
FIG. 3. is a side sectional view of the FIG. 2.
Figure 4:
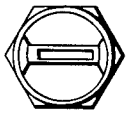
FIG. 4. is a top view of the FIG. 2.

FIG. 2 illustrates the mouthpiece 4 being connected to outer tube 2. FIG. 3 illustrates a side section of FIG. 2. FIG. 4 illustrates a top view of FIG. 2.

I claim:

1. A portable cigarette ash tube in combination with a cigarette holder and an extinguisher comprising an outer tubular body having a first end and a second end; a mouthpiece incorporating said cigarette holder being removably connectable to the first end of said outer tubular body; an inner tubular body having a first and second end; a cone shaped blade scratcher being secured to the first end of said inner tubular body; said scratcher having its cone blade being within said inner tubular body and pointing in the direction of said inner tubular body second end; said outer tubular body having its respective second end telescopically fit over said second end of said inner tubular body; said tubular bodies rotatable about a common longitudinal axis with respect to each other; whereby when said mouthpiece is removed an open ash tube end is formed which serves for the escape of ashes produced when the tubular bodies are connected to said mouthpiece and said scratcher rotates down onto the ember end of a lit cigarette extinguishing said cigarette.

2. The portable cigarette ash tube of claim 1 having ventilating micro holes provided on said inner tubular body; said micro holes are closed off when said outer tubular body covers said micro holes.

* * * * *